US008758070B2

(12) United States Patent
Ozaki

(10) Patent No.: US 8,758,070 B2
(45) Date of Patent: Jun. 24, 2014

(54) FORWARD-REVERSE SWITCHING DEVICE OF JET-PROPULSION WATERCRAFT

(75) Inventor: Taishi Ozaki, Yokohama (JP)

(73) Assignee: NHK Spring Co., Ltd., Yokohama-shi, Kanagawa (JP)

( * ) Notice: Subject to any disclaimer, the term of this patent is extended or adjusted under 35 U.S.C. 154(b) by 233 days.

(21) Appl. No.: 13/472,816

(22) Filed: May 16, 2012

(65) Prior Publication Data

US 2012/0295500 A1 Nov. 22, 2012

(30) Foreign Application Priority Data

May 20, 2011 (JP) ..... 2011-113384

(51) Int. Cl.
*B63H 11/11* (2006.01)
*B63H 20/08* (2006.01)

(52) U.S. Cl.
USPC ..... 440/41; 440/61 F

(58) Field of Classification Search
CPC ..... B63H 11/11
USPC ..... 440/40, 41, 61 F
See application file for complete search history.

(56) References Cited

U.S. PATENT DOCUMENTS 3,486,724 A * 12/1969 Adamski ..... 248/567
5,151,058 A * 9/1992 Tahara et al. ..... 440/61 R
6,729,918 B2 * 5/2004 Fuse et al. ..... 440/41
7,008,278 B2 * 3/2006 Miura ..... 440/84
8,579,668 B2 * 11/2013 Minoura et al. ..... 440/41

FOREIGN PATENT DOCUMENTS

JP 3121333 B2 * 12/2000
JP 2003-237693 A 8/2003

* cited by examiner

*Primary Examiner* — Stephen Avila
*Assistant Examiner* — Andrew Polay
(74) *Attorney, Agent, or Firm* — Holtz Holtz Goodman & Chick PC

(57) ABSTRACT

A device according to an embodiment includes a base member, a slide member movable longitudinally relative to the base member, and a locking member disposed on the slide member. When the slide member moves in a first direction, an arm member rotates in a first direction, whereupon a bucket is caused to ascend by a force transmission member. When the slide member moves in a second direction, the arm member rotates in a second direction, whereupon the bucket descends. When the slide member moves to a neutral position, the bucket is brought to a neutral state. In the neutral state, a fixed protrusion is fitted into a neutral locking groove portion, thereby locking the slide member, and an indicator is located corresponding to an opening, thereby indicating the neutral state.

5 Claims, 8 Drawing Sheets

Neutral position (locked state)

Neutral position (unlocked state)

Forward-side position (unlocked state)

Forward-side position (locked state)

Reverse-side position

FORWARD-REVERSE SWITCHING DEVICE OF JET-PROPULSION WATERCRAFT

CROSS-REFERENCE TO RELATED APPLICATIONS

This application is based upon and claims the benefit of priority from prior Japanese Patent Application No. 2011-113384, filed May 20, 2011, the entire contents of which are incorporated herein by reference.

BACKGROUND OF THE INVENTION

1. Field of the Invention

This invention relates to a forward-reverse switching device of a jet-propulsion watercraft, such as a personal watercraft.

2. Description of the Related Art

As described in Jpn. Pat. Appln. KOKAI Publication No. 2003-237693, the stern of a jet-propulsion watercraft, such as a personal watercraft, comprises a nozzle for jetting water, bucket for forward-reverse switching, etc. The bucket can be moved between up- and down-positions by a control unit with a control lever which is located in a front portion of the watercraft. If the bucket ascends, a water jet emitted from the nozzle directly flows backward relative to the hull of the watercraft without hitting the bucket, so that the jet-propulsion watercraft moves forward. If the bucket descends, the water jet from the nozzle hits the bucket and flows forward relative to the hull, so that the watercraft moves backward.

If the bucket is stopped at a vertically intermediate position, the water jet emitted from the nozzle is guided downward by the bucket. When this is done, the jet-propulsion watercraft is stopped without substantially moving forward or backward. This is a so-called neutral state. According to an example of the control unit of the conventional jet-propulsion watercraft, the bucket is caused to ascend by a push-pull cable if a watercraft operator pushes forward the control lever located in a front portion of the watercraft. If the operator pulls the control lever, the bucket is caused to descend by the push-pull cable. Thus, the bucket can be held in a neutral position depending on the position of the control lever.

In the jet-propulsion watercraft capable of forward-reverse switching based on the bucket position, as described above, the control lever is moved between forward- and reverse-side positions. However, the structure of the bucket does not allow the neutral position of the control lever to be located just halfway between the forward- and reverse-side positions. Specifically, the neutral position is located much closer to the reverse-side position. Therefore, the range of motion of the control lever from the neutral position to the forward-side position is considerably longer than the range of motion from the neutral position to the reverse-side position.

Conventionally, therefore, skill is required to accurately stop the bucket at the neutral position. In some cases, moreover, the bucket may unexpectedly move from the neutral position to the forward- or reverse-side position, thereby causing the jet-propulsion watercraft to move against the operator's intention. Under these circumstances, there has been a demand for the development of jet-propulsion watercrafts in which the bucket can be easily held in the neutral position.

BRIEF SUMMARY OF THE INVENTION

The object of the present invention is to provide a forward-reverse switching device of a jet-propulsion watercraft, capable of easily holding a bucket in a neutral position.

A forward-reverse switching device according to the present invention comprises a base member, slide member, control unit, and locking member. The base member is secured to a hull of a jet-propulsion watercraft and comprises a fixed protrusion. The slide member is movable relative to the base member between a forward-side position and a reverse-side position with a neutral position therebetween. The control unit comprises a grip member attached to the slide member and a control lever. The control lever is pivotable relative to the grip member about a shaft between first and second positions. The locking member is swingably disposed on the slide member. The locking member comprises a guide groove in which the fixed protrusion is fitted. The guide groove comprises a neutral locking groove portion. The neutral locking groove portion mates with the fixed protrusion when the slide member and the control lever are located in the neutral position and the first position, respectively. The neutral locking groove portion separates from the fixed protrusion when the control lever moves to the second position.

In the jet-propulsion watercraft configured so that forward, reverse, and neutral modes can be selected depending on the position of a bucket, according to this arrangement, the slide member can be locked when the bucket is in its neutral position. Thus, the watercraft can be practically stopped with ease without stopping water jet emission.

According to an embodiment of the invention, the control lever comprises an indicator. The indicator corresponds in position to an opening in the grip member when the slide member is locked in the neutral position. According to this arrangement, the bucket in the neutral position can be visually recognized from the outside. According to an embodiment, moreover, the range of motion of the slide member from the neutral position to the reverse-side position is shorter than the range of motion from the neutral position to the forward-side position. By the use of the indicator and the opening, in this case, the neutral position can be visually recognized, so that the bucket can be more easily held in the neutral position.

According to an embodiment of the invention, the guide groove comprises a forward locking groove portion. The forward locking groove portion mates with the fixed protrusion when the slide member and the control lever move to the forward-side position and toward the first position, respectively. According to this arrangement, the slide member can be locked in the forward-side position, so that the bucket can be prevented from being lowered from its up-position by an unexpected external force or the like during watercraft operation. Further, the control lever may be made from a synthetic resin and partially formed with a spring portion which urges the control lever toward the first position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A jet-propulsion watercraft comprising a forward-reverse switching device according to one embodiment of the present invention will now be described with reference to FIGS. 1 to 9.

Figure 1:
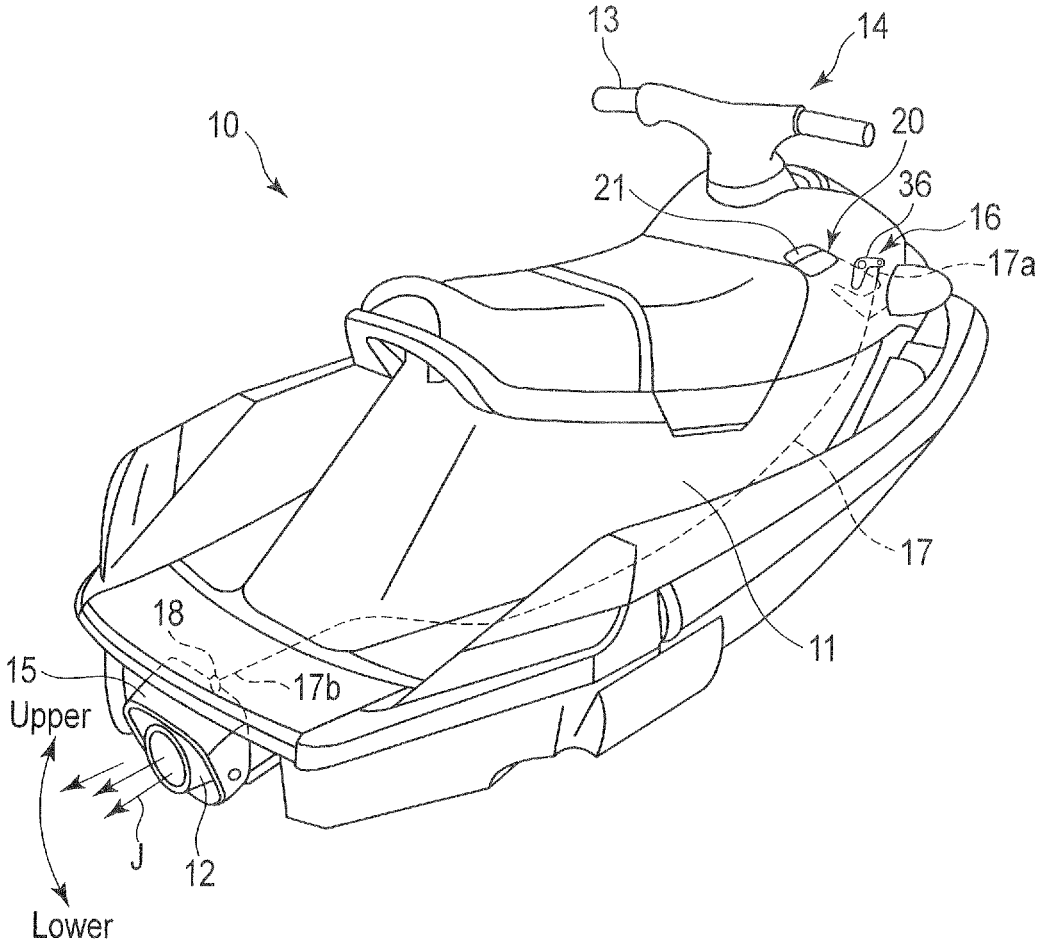
FIG. 1 is a perspective view of a jet-propulsion watercraft comprising a forward-reverse switching device according to one embodiment of the invention.

FIG. 1 shows an example of a jet-propulsion watercraft (personal watercraft) 10. The watercraft 10 comprises a hull 11, nozzle 12, steering gear 14 comprising a handlebar 13, bucket 15, and forward-reverse switching device 16. The nozzle 12 is disposed at the back of the hull 11 and emits water jet J. The handlebar 13 is used to redirect the nozzle 12. The bucket 15 is disposed near the nozzle 12. The forward-reverse switching device 16 controls the watercraft 10 forward or backward by vertically moving the bucket 15.

The forward-reverse switching device 16 is connected with one end 17*a* of a force transmission member 17 for remote control, such as a push-pull cable. The other end 17*b* of the force transmission member 17 is connected to a controlled portion 18 of the bucket 15. The switching device 16 controls the watercraft 10 forward or backward by causing the force transmission member 17 to move the bucket 15 vertically.

Figure 2A:
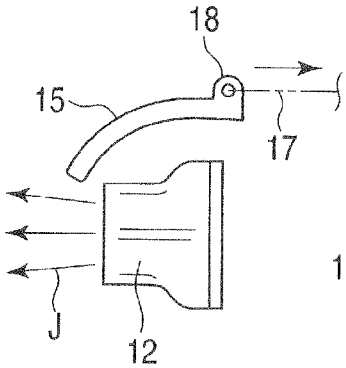
FIG. 2A is a side view showing a direction in which water flows when a bucket of the jet-propulsion watercraft is in its up-position.
Figure 2B:
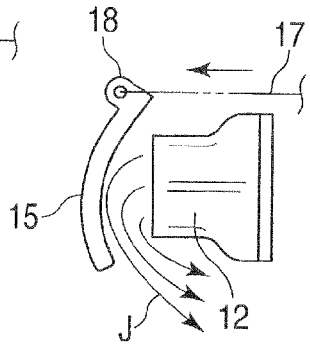
FIG. 2B is a side view showing a direction in which water flows when the bucket is in its down-position.
Figure 2C:
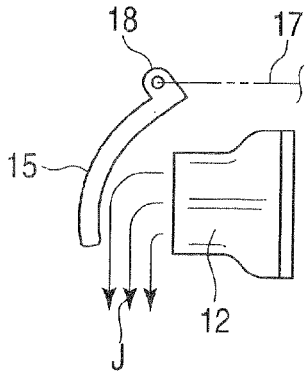
FIG. 2C is a side view showing a direction in which water flows when the bucket is in its intermediate position.

FIGS. 2A to 2C individually show relationships between the position of the bucket 15 and the direction of water jet J emitted from the bucket 15. When the bucket 15 is in an up-position, as shown in FIG. 2A, water jet J emitted from the nozzle 12 directly flows backward. Thereupon, the jet-propulsion watercraft 10 moves forward. When the bucket 15 descends and faces the nozzle 12, as shown in FIG. 2B, water jet J emitted from the nozzle 12 hits the bucket 15 and is redirected forward. Thereupon, the watercraft 10 moves backward.

When the bucket 15 is held in a vertically intermediate position, as shown in FIG. 2C, water jet J emitted from the nozzle 12 flows downward, guided by the bucket 15. Thus, the jet-propulsion watercraft 10 is stopped without substantially moving forward or backward. This state is referred to as "neutral" herein.

Figure 3:
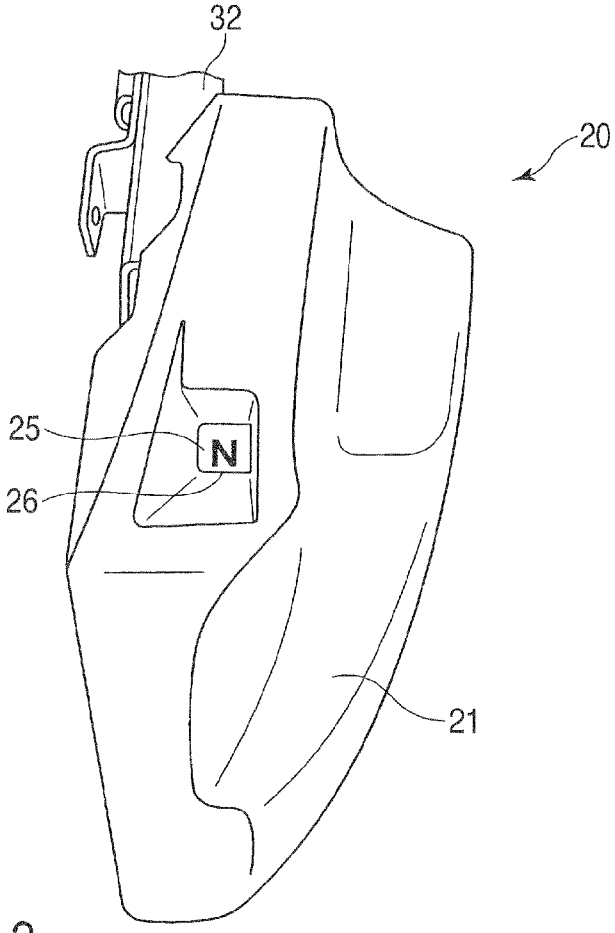
FIG. 3 is a perspective view showing a control unit of the forward-reverse switching device of the jet-propulsion watercraft shown in FIG. 1.
Figure 4:
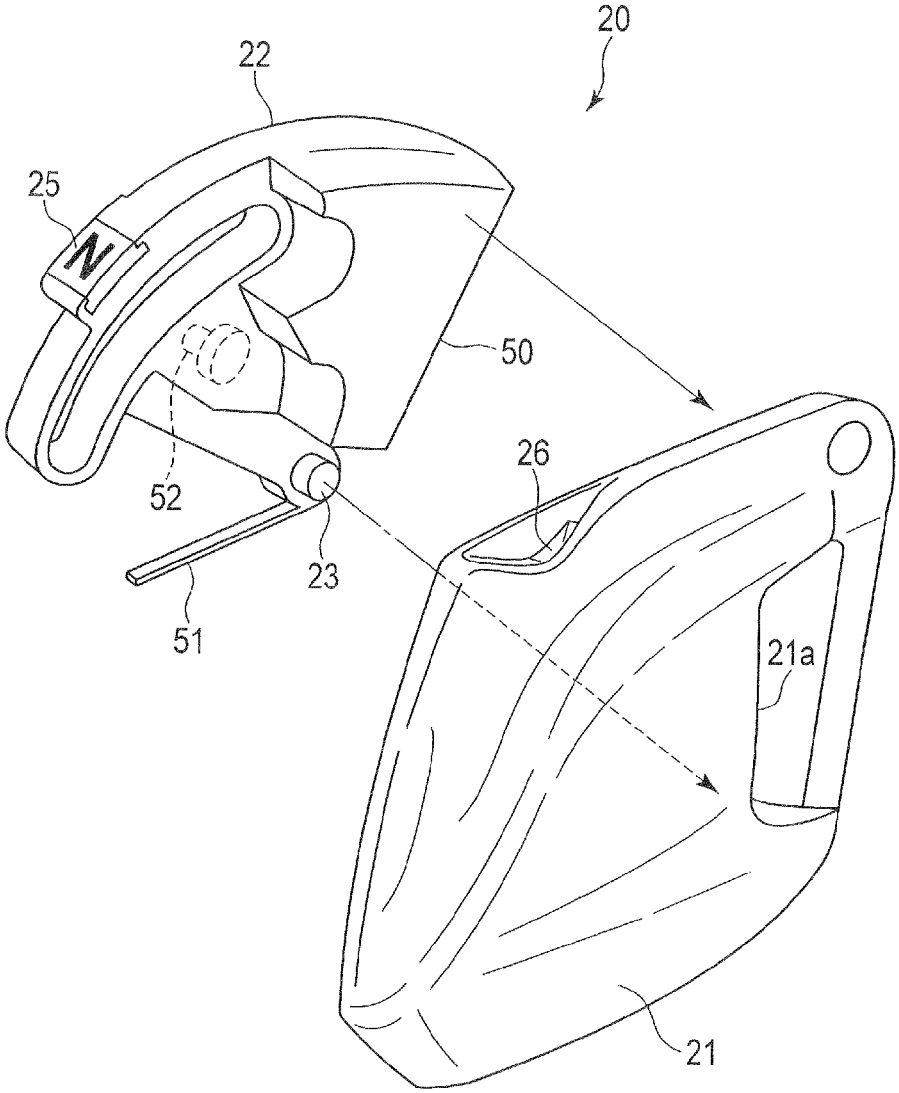
FIG. 4 is an exploded perspective view of the control unit shown in FIG. 3.

FIGS. 3 and 4 show a control unit 20 of the forward-reverse switching device 16 for operating the bucket 15. The control unit 20 comprises a grip member 21 of a shape that facilitates an operator's grip and a control lever 22 mounted on the grip member 21. The control lever 22 is pivotable relative to the grip member 21 about a shaft 23 between first and second positions. The first position is an initial position where no operating force is applied to the grip member 21. The second position is a position where the grip member 21 is depressed by operating force.

The control lever 22 comprises an indicator 25. The indicator 25 indicates that the bucket 15 is locked in its neutral position. An opening 26 is formed on the top side of the grip member 21. When a slide member 32 (described later) is in its neutral position, the indicator 25 is located in a position corresponding to the opening 26. Accordingly, the indicator 25 can be visually observed through the opening 26 from outside the grip member 21. While character "N" is given as an example of the indicator 25, it may be replaced with some other character, symbol, or pattern.

The following is a detailed description of the forward-reverse switching device 16.

Figure 5:
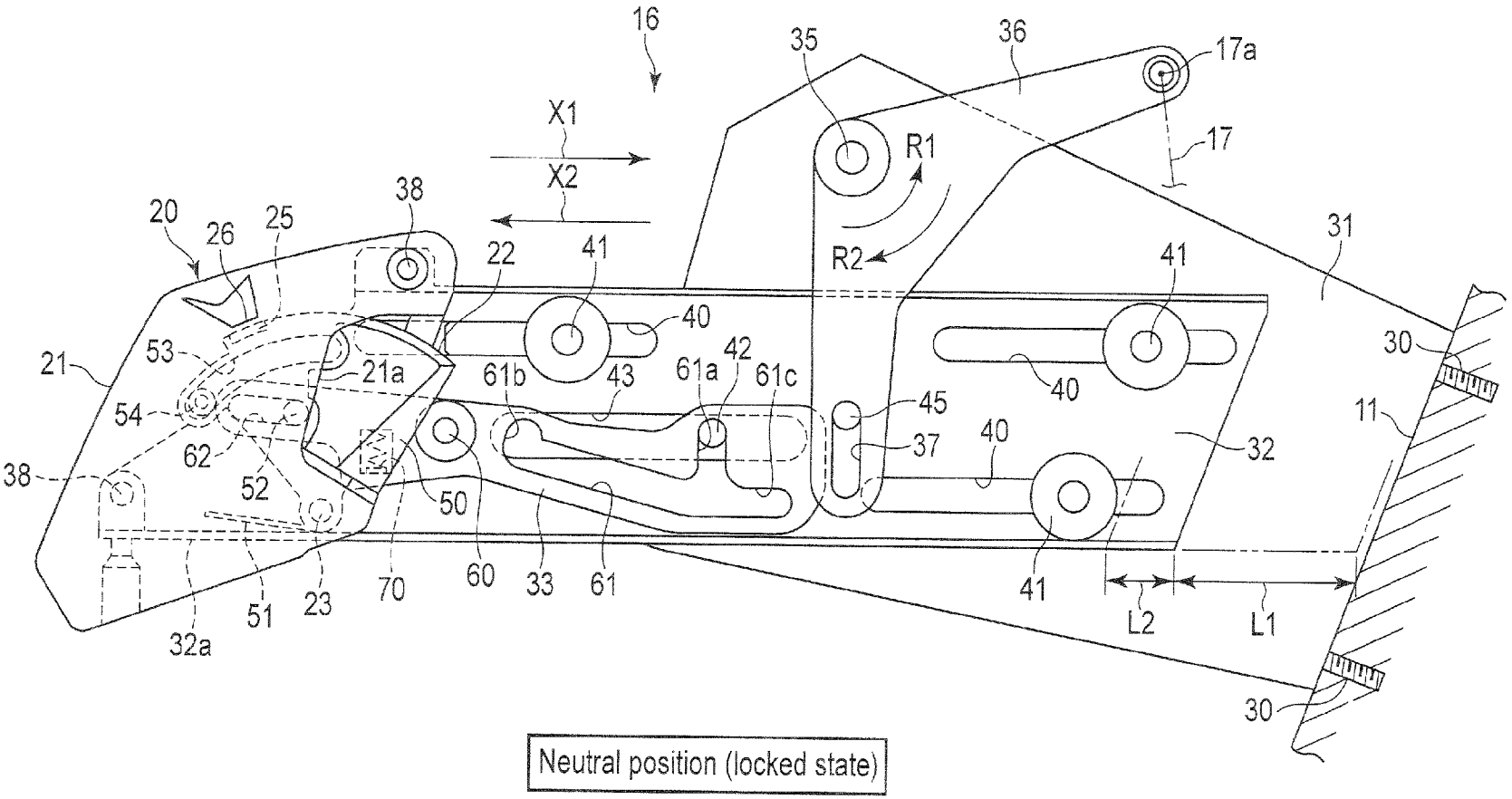
FIG. 5 is a side view showing a state in which a slide member of the forward-reverse switching device of the jet-propulsion watercraft of FIG. 1 is locked in its neutral position.

FIG. 5 shows a state in which the forward-reverse switching device 16 is in its neutral position. The switching device 16 comprises a base member 31, the slide member 32, a locking member 33 on the slide member 32, arm member 36, the grip member 21, the control lever 22, etc. The base member 31 is secured to the hull 11 by fixing members 30, such as bolts. The slide member 32 is movable longitudinally (in the directions indicated by arrows X1 and X2 in FIG. 5) relative to the base member 31. The arm member 36 is pivotable in a first direction (indicated by arrow R1) and second direction (indicated by arrow R2) about a pivot 35. The grip member 21 is secured to an end portion 32*a* (nearer to the watercraft operator) of the slide member 32 by a fixing member 38. The one end 17*a* of the force transmission member 17 (schematically indicated by a two-dot chain line) is connected to one end of the arm member 36. A slit 37 is formed at the other end of the arm member 36.

The slide member 32 comprises a plurality of longitudinal guide grooves 40. The base member 31 comprises a plurality of guide members 41. The guide members 41 are slidably fitted in their corresponding guide grooves 40. Specifically, the slide member 32 is movable relative to the base member 31 within the range of length L1 (FIG. 5) on the forward side and within the range of length L2 on the reverse side along the guide grooves 40. The slide member 32 can linearly move within the range of motion of length (L1+L2) between a forward-side position (FIGS. 7 and 8) and reverse-side position (FIG. 9) with the neutral position of FIG. 5 therebetween.

The base member 31 comprises a pin-like fixed protrusion 42. The fixed protrusion 42 projects toward the locking member 33 through a slot 43 in the slide member 32. Further, the slide member 32 comprises a pin-like engaging portion 45. The engaging portion 45 can be inserted into the slit 37 which is formed in the arm member 36 and moved longitudinally relative to the slit 37.

If the slide member 32 moves (forward) in the direction of arrow X1, the engaging portion 45 also moves in the direction of arrow X1, whereupon the arm member 36 rotates in the direction of arrow R1. If the slide member 32 moves (backward) in the direction of arrow X2, the engaging portion 45 also moves in the direction of arrow X2, whereupon the arm member 36 rotates in the direction of arrow R2.

The control lever 22 is made from a synthetic resin. The control lever 22 integrally comprises an operation panel 50, plate-like spring portion 51, pin-like movable protrusion 52, groove-like guide portion 53, etc. The watercraft operator can manually operate the operation panel 50. The guide portion 53 has the shape of a circular arc around the shaft 23. The operation panel 50 projects outside an opening 21*a* in the grip member 21.

A receiving portion 54, such as a roller, disposed on the grip member 21 is fitted in the guide portion 53 of the control lever 22. The control lever 22 can smoothly pivot along the guide portion 53 about the shaft 23. The spring portion 51 urges the control lever 22 in such a direction that the operation panel 50 projects from the opening 21*a* of the grip member 21. Thus, the spring portion 51 urges the control lever 22 toward the first position.

The locking member 33 on the slide member 32 is swingable about a pivot 60. The locking member 33 is movable (pivotable) in a clockwise locking direction and counterclockwise unlocking direction, as in FIG. 5. The locking member 33 is formed with first and second guide grooves 61 and 62 that extend longitudinally. The second guide groove 62 is located on the opposite side of the pivot 60 to the first guide groove 61. The fixed protrusion 42 is fitted in the first guide groove 61, and the movable protrusion 52 in the second guide groove 62.

The first guide groove 61 comprises a neutral locking groove portion 61*a*, forward locking groove portion 61*b*, and reverse groove portion 61*c*. The locking member 33 is always urged in the locking direction (clockwise direction in FIG. 5) by a spring 70.

The operation of the forward-reverse switching device 16 will now be described with reference to FIGS. 5 to 9.

FIG. 5 shows the state in which the slide member 32 is locked in its neutral position. When the slide member 32 is in the neutral position, the arm member 36 in engagement with the engaging portion 45 is also held in its neutral position. Thereupon, the bucket 15 is held in its neutral position by the force transmission member 17. If the control lever 22 is in the first position when the neutral position is maintained, the neutral locking groove portion 61*a* mates with the fixed protrusion 42. In this way, the slide member 32 is locked in the neutral position.

If the arm member 36 is thus held in its neutral position, the bucket 15 is held in its neutral position, as shown in FIG. 2C, whereupon the jet-propulsion watercraft 10 is stopped. Since the indicator 25 of the control lever 22 is then located in the opening 26 of the grip member 21, the watercraft operator can easily visually recognize that the bucket 15 is neutral. Since the slide member 32 is locked, moreover, the bucket 15 is also locked.

Since the bucket 15 is locked as described above, the jet-propulsion watercraft 10 can be prevented from moving forward or backward against the operator's intention. If the operator holds the grip member 21 in this neutral position and manually moves the control lever 22 to the second position (in the unlocking direction), the operating state is changed to the unlocked state of FIG. 6.

Figure 6:
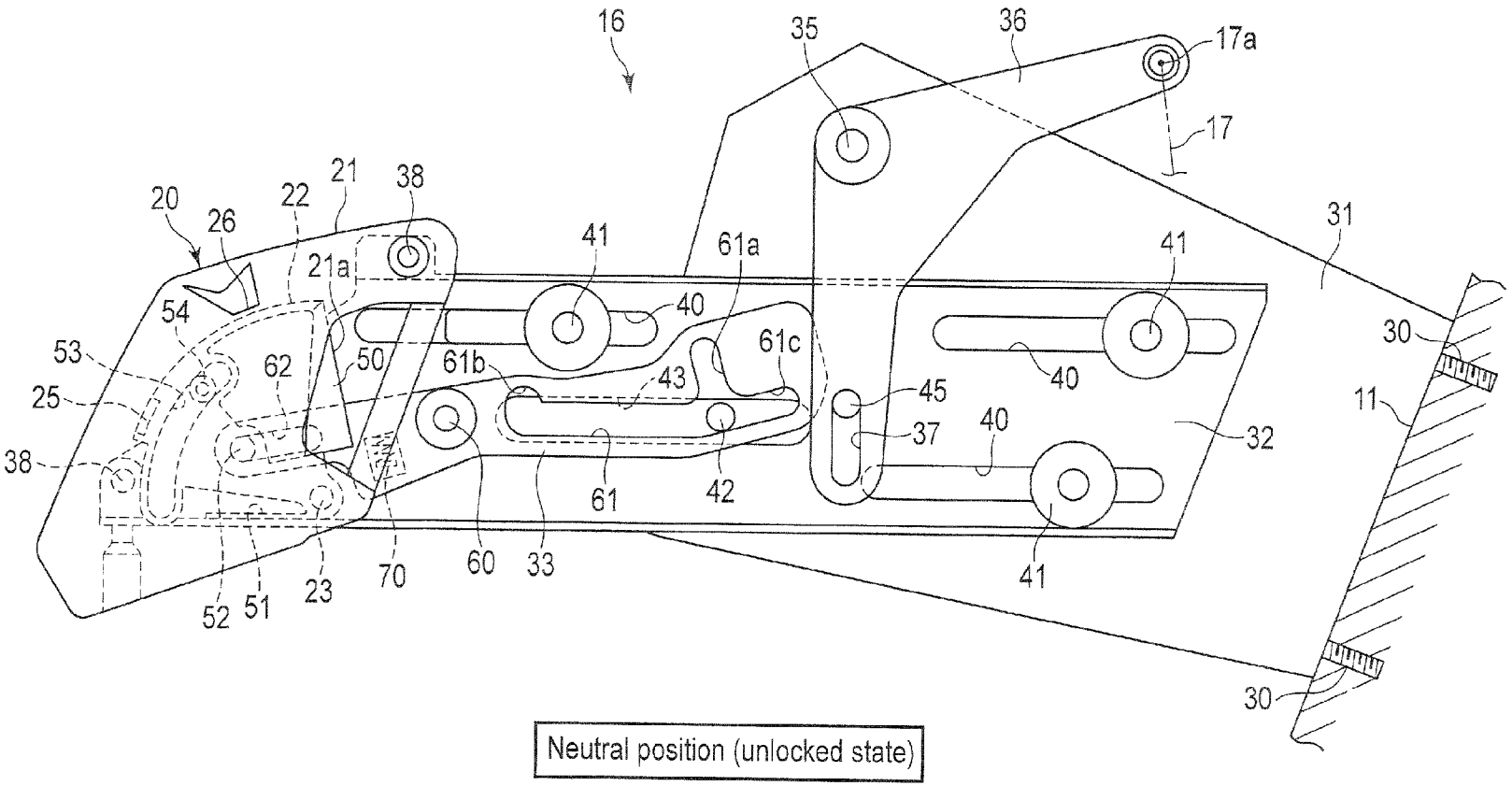
FIG. 6 is a side view showing a state in which the slide member of the forward-reverse switching device shown in FIG. 5 is unlocked.

FIG. 6 shows a state in which the locking member 33 is in an unlocked position. If the control lever 22 moves to the second position (in the unlocking direction), the movable protrusion 52 moves in a circular arc in the second guide groove 62 around the shaft 23. Thereupon, the locking member 33 moves in the unlocking direction (counterclockwise direction) around the pivot 60, resisting the elasticity of the spring 70.

Thereupon, the neutral locking groove portion 61*a* is disengaged from the fixed protrusion 42. Accordingly, the slide member 32 is unlocked and allowed to move longitudinally (in the directions indicated by arrows X1 and X2 in FIG. 5) relative to the base member 31. In this unlocked position, the indicator 25 does not face the opening 26, and hence, is hidden.

Figure 7:
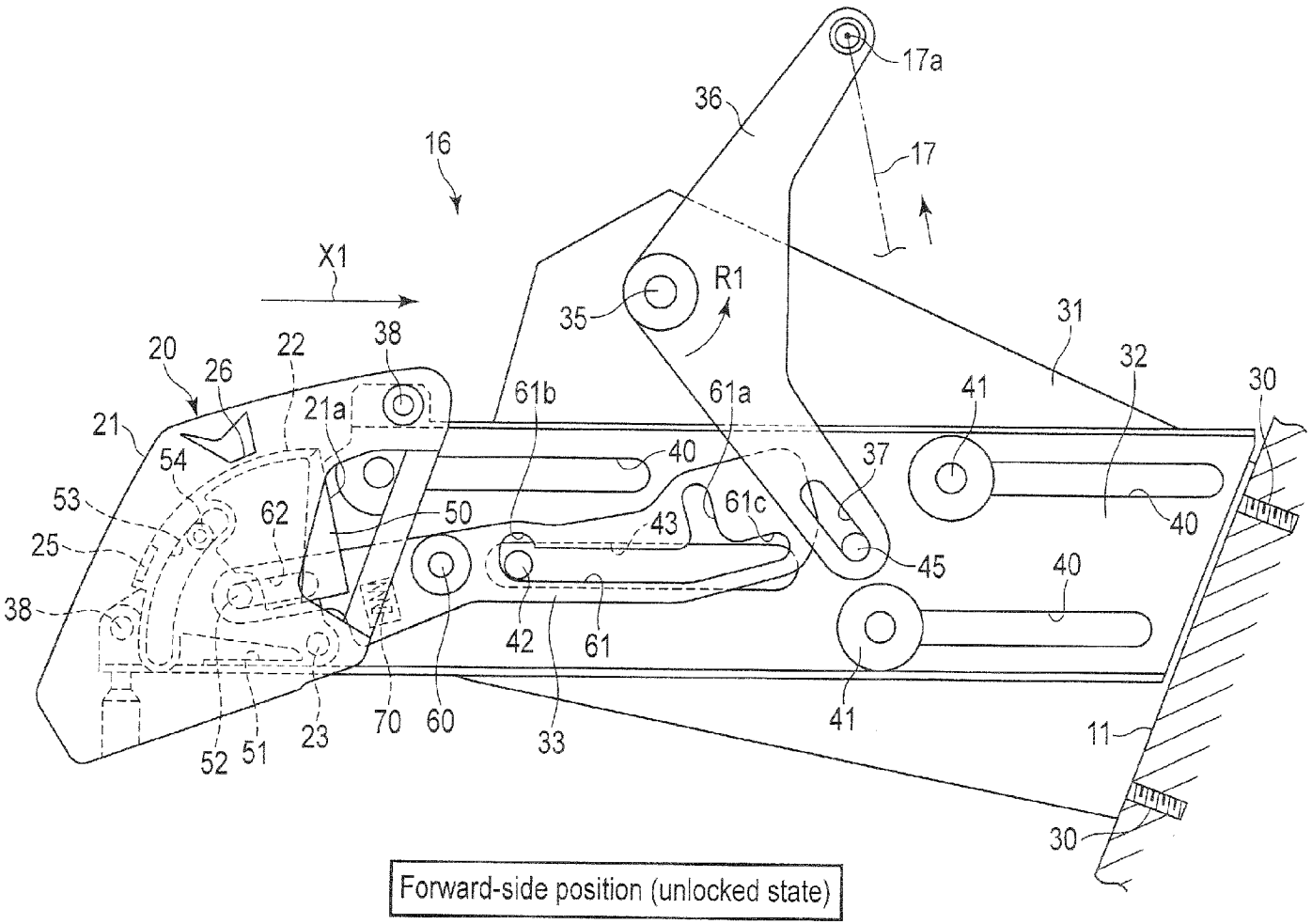
FIG. 7 is a side view showing the slide member of the forward-reverse switching device of FIG. 5 in a forward-side position.
Figure 8:
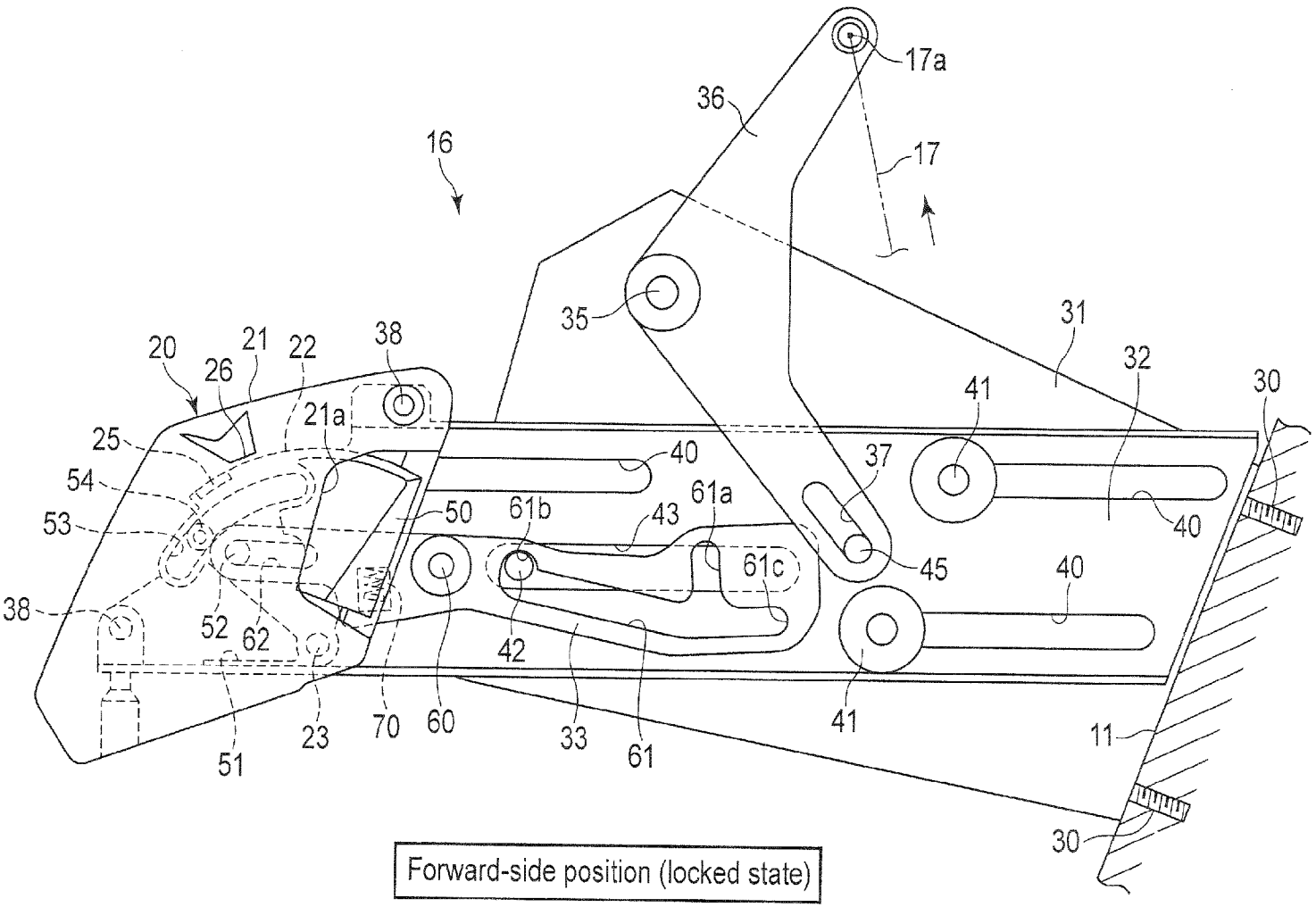
FIG. 8 is a side view showing the slide member of the forward-reverse switching device of FIG. 5 locked in the forward-side position.

FIG. 7 shows the slide member 32 in the forward-side position. If the slide member 32 moves in the direction of arrow X1 toward the forward-side position, the engaging portion 45 also moves in the direction of arrow X1. Thereupon, the arm member 36 rotates in the first direction R1, and the force transmission member 17 is pulled, so that the bucket 15 moves to the up-position shown in FIG. 2A. If the control lever 22 is released in this state, the control lever 22 is returned to the first position (locked position) by the elasticity of the spring portion 51, as shown in FIG. 8. At the same time, the locking member 33 is moved in the locking direction (clockwise direction) around the pivot 60 by the elasticity of the spring 70.

FIG. 8 shows the slide member 32 in the forward-side position and the locking member 33 in the locked position. In the forward-side locked position, the forward locking groove portion 61*b* mates with the fixed protrusion 42 when the control lever 22 is moved toward the first position. Thereupon, the slide member 32 is locked in the forward-side position. If the control lever 22 is pressed and moved to the second position, the forward locking groove portion 61*b* separates from the fixed protrusion 42, whereupon the slide member 32 is unlocked.

If the slide member 32 moves to the forward side, as shown in FIG. 8, the bucket 15 is held in the up-position, as shown in FIG. 2A. Thereupon, water jet J emitted from the nozzle 12 is directed backward relative to the hull 11, so that the jet-propulsion watercraft 10 moves forward. In this forward-side position, the indicator 25 does not face the opening 26, and hence, is hidden. Since the slide member 32 is then locked on the forward side, the bucket 15 is locked in the forward-side position by the force transmission member 17. If any external force acts on the bucket 15 during the watercraft operation, the bucket 15 can be prevented from descending against the operator's intention.

Figure 9:
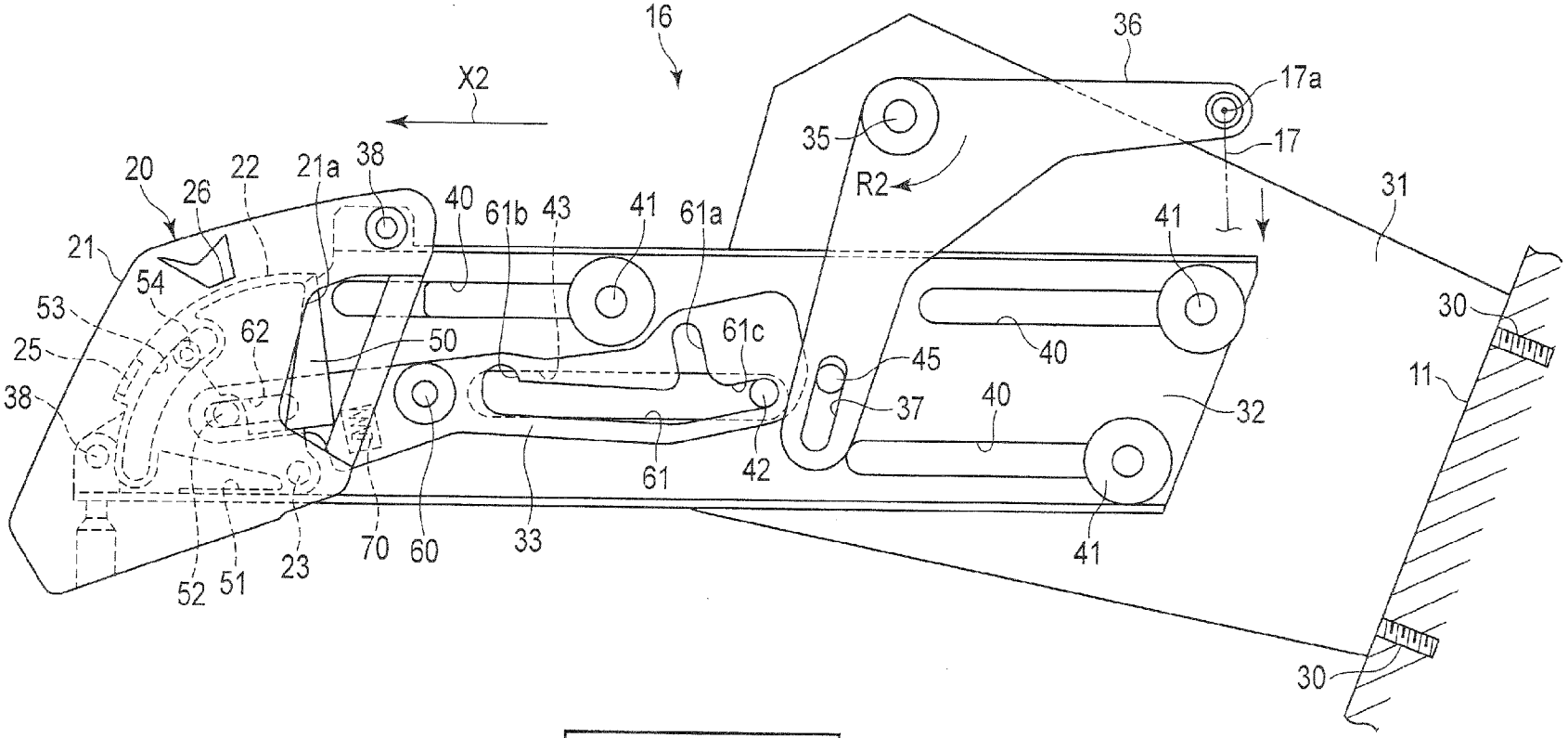
FIG. 9 is a side view showing the slide member of the forward-reverse switching device of FIG. 5 in a reverse-side position.

FIG. 9 shows the slide member 32 in the reverse-side position. If the slide member 32 moves in the direction of arrow X2 toward the reverse-side position, the fixed protrusion 42 gets into the reverse groove portion 61*c*. At the same time, the engaging portion 45 moves in the direction of arrow X2, whereupon the arm member 36 rotates in the second direction R2.

Thus, if the force transmission member 17 is pushed, the bucket 15 moves to a down-position shown in FIG. 2B. If the bucket 15 moves to the down-position, water jet J emitted from the nozzle 12 hits the bucket 15 and is directed forward relative to the hull 11, so that the jet-propulsion watercraft 10 moves backward. In this reverse-side position, the indicator 25 does not face the opening 26, and hence, is hidden.

The amount of movement of the bucket 15 from the up-position (FIG. 2A) to the neutral position (FIG. 2C) is several times or more larger than that from the down-position (FIG. 2B) to the neutral position. In FIG. 5, symbols L1 and L2 denote the lengths of the ranges of motion of the slide member 32 from the neutral position (FIG. 5) to the forward-side position (FIGS. 7 and 8) and reverse-side position (FIG. 9), respectively. Since L2 is considerably smaller than L1, it is not easy to locate the neutral position of the slide member 32.

According to the forward-reverse switching device 16 of the present embodiment, however, the slide member 32 can be locked in the neutral position, and the indicator 25 of the control lever 22 can indicate that the slide member 32 is in the neutral position, as described before. Thus, there is an advantage that the watercraft can be relatively easily operated with the bucket 15 in the neutral position.

It is to be understood, in carrying out the present invention, that the configurations and layouts of various constituent elements of the forward-reverse switching device of the jet-propulsion watercraft, including the base member, slide member, control unit, locking member, etc., may be embodied in various modified forms. Further, the forward-reverse switching device of the present invention is also applicable to some jet-propulsion watercrafts with a jet-propulsion mechanism other than personal watercrafts.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A forward-reverse switching device of a jet-propulsion watercraft which comprises a nozzle and a bucket, comprising:

a base member secured to a hull of the jet-propulsion watercraft and comprising a fixed protrusion;

a slide member movable relative to the base member between a forward-side position and a reverse-side position with a neutral position therebetween;

a control unit comprising a grip member attached to the slide member and a control lever pivotable relative to the grip member about a shaft between first and second positions; and a locking member swingably disposed on the slide member and comprising a guide groove in which the fixed protrusion is fitted, the guide groove comprising a neutral locking groove portion, which mates with the fixed protrusion when the slide member and the control lever are located in the neutral position and the first position, respectively, and separates from the fixed protrusion when the control lever moves to the second position.

2. The forward-reverse switching device of a jet-propulsion watercraft of claim 1, wherein the control lever comprises an indicator which corresponds in position to an opening in the grip member, thereby becoming visually recognizable from the outside, when the slide member is locked in the neutral position.

3. The forward-reverse switching device of a jet-propulsion watercraft of claim 2, wherein the range of motion of the slide member from the neutral position to the reverse-side position is shorter than the range of motion from the neutral position to the forward-side position.

4. The forward-reverse switching device of a jet-propulsion watercraft of claim 1, wherein the guide groove comprises a forward locking groove portion which mates with the fixed protrusion when the slide member and the control lever move to the forward-side position and toward the first position, respectively.

5. The forward-reverse switching device of a jet-propulsion watercraft of claim 1, wherein the control lever is made from a synthetic resin and partially formed with a spring portion which urges the control lever toward the first position.

* * * * *